US011160390B2

(12) United States Patent
Micklos et al.

(10) Patent No.: US 11,160,390 B2
(45) Date of Patent: Nov. 2, 2021

(54) MATTRESS COVER

(71) Applicant: Sinomax USA Inc., Houston, TX (US)

(72) Inventors: Josh Micklos, Montgomery, TX (US); Michael Carter, Stephens City, VA (US); Yee Mei Mok, Houston, TX (US)

(73) Assignee: SINONAX USA, INC., Houston, TX (US)

( * ) Notice: Subject to any disclaimer, the term of this patent is extended or adjusted under 35 U.S.C. 154(b) by 224 days.

(21) Appl. No.: 16/111,989

(22) Filed: Aug. 24, 2018

(65) Prior Publication Data

US 2020/0060431 A1 Feb. 27, 2020

(51) Int. Cl.
*A47C 31/10* (2006.01)
*A47C 27/14* (2006.01)

(52) U.S. Cl.
CPC ..... *A47C 31/105* (2013.01); *A47C 27/144* (2013.01)

(58) Field of Classification Search
CPC .... A47C 31/105; A47C 27/144; A47C 27/007
USPC ..... 5/724
See application file for complete search history.

(56) References Cited

U.S. PATENT DOCUMENTS 4,445,241 A * 5/1984 Ender ..... A47C 27/006 5/652.1
4,665,575 A * 5/1987 Raught ..... A47C 21/046 441/128
5,090,074 A * 2/1992 Scales ..... A47C 27/006 5/500
5,727,266 A * 3/1998 Pang ..... A47G 9/0253 5/490
5,896,605 A * 4/1999 Branman ..... A47C 21/00 5/716
7,059,001 B2 * 6/2006 Woolfson ..... A47C 21/046 5/699
D704,965 S * 5/2014 Arnold ..... D6/605
9,167,922 B1 * 10/2015 Holbrook ..... A47G 9/10
9,167,923 B1 * 10/2015 Holbrook ..... A47G 9/0253
9,265,369 B1 * 2/2016 Beliveau ..... A47G 9/1036
9,997,089 B2 * 6/2018 Jensen ..... A47C 31/105
2010/0235992 A1 * 9/2010 Bensoussan ..... A61G 7/047 5/424
2011/0035879 A1 * 2/2011 Grinstead ..... A47C 21/046 5/421
2011/0154575 A1 * 6/2011 Kiser ..... A47C 27/007 5/706
2016/0157631 A1 * 6/2016 Milnes ..... A47C 27/148 5/691
2016/0255965 A1 * 9/2016 Apitz ..... A47C 27/007
2017/0007036 A1 * 1/2017 Scarleski ..... A47C 21/028

* cited by examiner

*Primary Examiner* — Myles A Throop
(74) *Attorney, Agent, or Firm* — Williams Morgan, P.C.

(57) ABSTRACT

A mattress cover, comprising a top layer; a first side layer comprising a first air-impermeable portion, a first air-permeable portion, a first air-impermeable flap, and first affixing apparatus, wherein the first affixing apparatus is configured to reversibly affix the first air-impermeable flap over the first air-permeable portion; a second side layer comprising a second air-impermeable portion, a second air-permeable portion, a second air-impermeable flap, and second affixing apparatus, wherein the second affixing apparatus is configured to reversibly affix the second air-impermeable flap over the second air-permeable portion; a head layer; and a foot layer.

15 Claims, 3 Drawing Sheets

MATTRESS COVER

BACKGROUND OF THE INVENTION

Field of the Invention

Generally, the present disclosure relates to bedding, and, more specifically, to a mattress cover.

Description of the Related Art

Foam mattresses, such as viscoelastic or "memory foam" mattresses, provide desirably high levels of firmness and support for many users. However, one common consumer complaint regarding foam mattresses is that they "sleep hot," i.e., that the mattress tends to retain the user's body heat and render the mattress less comfortable for sleep.

In an effort to alleviate the tendency of foam mattresses to "sleep hot," workers have created airflow channels within a mattress. For example, U.S. Pat. No. 6,866,915 discloses a mattress including a viscoelastic foam layer atop a middle layer, wherein the middle layer has a non-plane surface abutting the viscoelastic foam layer. The non-plane surface may contain undulations, thereby providing airflow channels between the undulations.

However, the presence of an airflow channel in a mattress may have some undesirable side effects. For example, the accumulation of foreign bodies (i.e., toys deposited by small children; hair shed by pets; etc.) in the airflow channels of a mattress are unsightly and may impair airflow through the channels.

The present disclosure may address and/or at least reduce one or more of the problems identified above.

SUMMARY OF THE INVENTION

The following presents a simplified summary of the disclosure in order to provide a basic understanding of some aspects of the disclosure. This summary is not an exhaustive overview of the disclosure. It is not intended to identify key or critical elements of the disclosure, or to delineate the scope of the disclosure. Its sole purpose is to present some concepts in a simplified form as a prelude to the more detailed description that is discussed later.

Generally, the present disclosure is directed to a mattress cover, comprising a top layer; a first side layer comprising a first air-impermeable portion, a first air-permeable portion, a first air-impermeable flap, and first affixing apparatus, wherein the first affixing apparatus is configured to reversibly affix the first air-impermeable flap over the first air-permeable portion; a second side layer comprising a second air-impermeable portion, a second air-permeable portion, a second air-impermeable flap, and second affixing apparatus, wherein the second affixing apparatus is configured to reversibly affix the second air-impermeable flap over the second air-permeable portion; a head layer; and a foot layer.

In another embodiment, the present disclosure relates to a mattress assembly, comprising a mattress having an opposed pair of long sides and an opposed pair of short sides and comprising at least one foam layer and at least one continuous air passage from one of the long sides to the other long side; and a mattress cover as described above.

In an additional embodiment, the present disclosure relates to a mattress cover package, comprising a mattress cover as described above, and a label indicating one or more mattresses that the mattress cover is configured to fit.

The present disclosure may provide for improved airflow within a mattress while resisting the inclusion of foreign bodies in airflow channels of a mattress and maintaining a desirable appearance to the mattress and mattress cover.

BRIEF DESCRIPTION OF THE DRAWINGS

The disclosure may be understood by reference to the following description taken in conjunction with the accompanying drawings, in which like reference numerals identify like elements, and in which.

Figure 1:
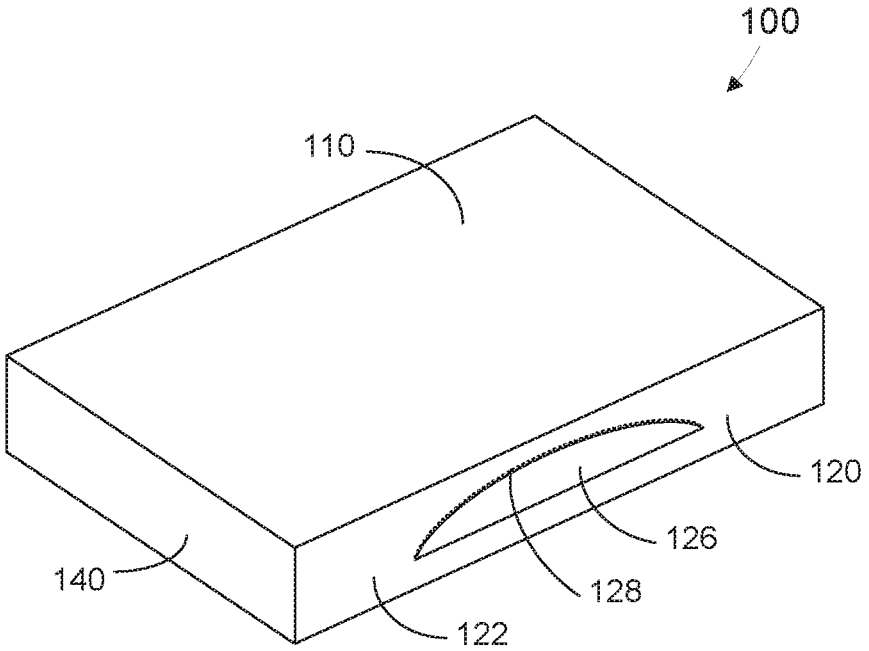
FIG. 1 illustrates a stylized perspective view of a first mattress cover in a first configuration, in accordance with embodiments herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

Various illustrative embodiments of the disclosure are described below. In the interest of clarity, not all features of an actual implementation are described in this specification. It will, of course, be appreciated, that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would be a routine undertaking for those of ordinary skill in the art having the benefit of this disclosure.

The present subject matter will now be described with reference to the attached figures. Various structures, systems and devices are schematically depicted in the drawings for purposes of explanation only and to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Embodiments herein are directed to mattress covers. The mattress covers of embodiments herein allow air to flow into and out of airflow channels within the mattress. The mattress covers of embodiments herein may also exclude foreign bodies from entering the airflow channels and maintaining a desirable appearance to the mattress and mattress cover.

Turning to FIG. 1, a stylized perspective view of a first mattress cover in a first configuration, is illustrated in accordance with embodiments herein. A first mattress cover 100 contains a top layer 110. The top layer 110 may have substantially the same length and width as the length and the width of the top of any mattress, such as a mattress having one of the standard sizes (e.g., twin, 75 inches by 39 inches; twin XL, 80 inches by 39 inches; full, 75 inches by 54 inches; queen, 80 inches by 60 inches; king, 80 inches by 76 inches; California king, 84 inches by 72 inches). The top layer 110 may be formed of any desired material, and may comprise a plurality of sublayers, e.g. a base layer, a pillow-top layer, etc. (not shown).

The first mattress cover 100 also comprises a first side layer 120. Referring simultaneously to FIG. 1 and the stylized side view of the first side layer 120 presented in FIG. 2, the first side layer 120 comprises a first air-impermeable portion 122, a first air-permeable portion 124, a first air-impermeable flap 126, and first affixing apparatus 128, wherein the first affixing apparatus 128 is configured to reversibly affix the first air-impermeable flap 126 over the first air-permeable portion.

The first air-impermeable portion 122 and the first air-impermeable flap 126 may comprise any fabric(s) in any thickness whereby the fabric(s) are impermeable to air. Although essentially all fabrics are breathable to some extent, as used herein in one embodiment, a fabric is "air-impermeable" if less than 10% of air directed against it passes through the fabric upon performance of ASTM D737 (based on the international standards organization ASTM International), standard test method for air permeability of textile fabrics.

In some embodiments, the first air-impermeable portion 122 and the first air-impermeable flap 126 may each comprise the same fabric, but need not.

Figure 2:
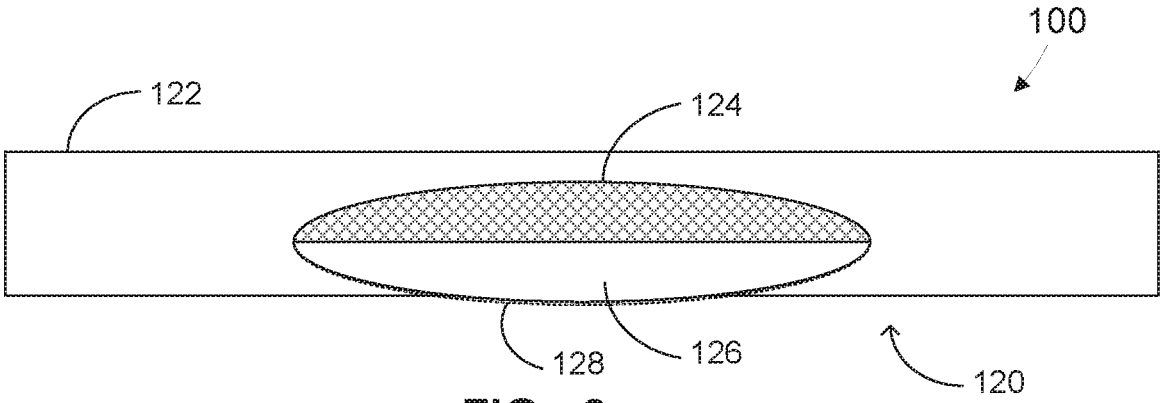
FIG. 2 illustrates a stylized first side view of the first mattress cover in a second configuration, in accordance with embodiments herein.
Figure 3:
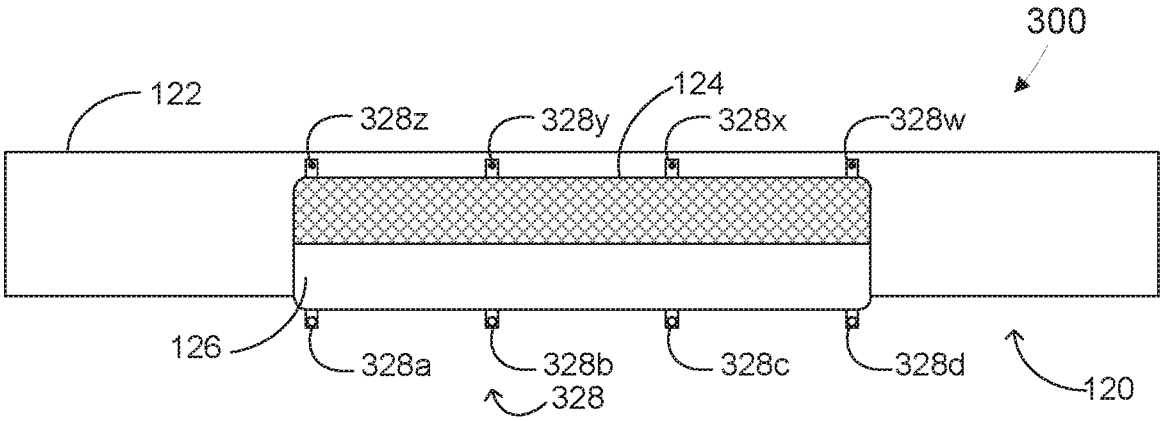
FIG. 3 illustrates a stylized first side view of a second mattress cover in a second configuration, in accordance with embodiments herein.

In many embodiments, the first air-impermeable flap 126, depicted in FIGS. 1-3, is permanently affixed to the first air-impermeable portion 122 along the bottom edge of the first air-permeable portion 124. The other edges of the first air-impermeable flap 126 depicted in FIGS. 1-3 are reversibly affixable to the first air-impermeable portion 122 along the other edges of the first air-permeable portion 124.

The first air-permeable portion 124 may comprise any material in a thickness whereby the material is impermeable to air. In one embodiment, the first air-permeable portion 124 may comprise a material wherein more than 50% of air directed against it passes through the material upon performance of ASTM D737. In a further embodiment, the first air-permeable portion 124 may comprise a material wherein more than 90% of air directed against it passes through the material upon performance of ASTM D737.

In one embodiment, the first air-permeable portion 124 may comprise a mesh.

Referring simultaneously to FIG. 1, FIG. 2, and FIG. 3, the latter shows a stylized side view of a first side 320 of a second mattress cover 300 in accordance with embodiments herein. The first affixing apparatus 128 may comprise any affixing apparatus usable in reversibly changing the first air-impermeable flap 126 from a first, closed configuration, as shown in FIG. 1. The first air-impermeable flap 126 substantially completely covers the first air-permeable portion 124, to a second, open configuration such as is shown in FIG. 2, wherein the first air-impermeable flap 126 permits air to flow into the first air-permeable portion 124. In one embodiment, the first affixing apparatus 128 is selected from a zipper, one or more button closures, one or more snap closures, or one or more hook-and-loop closures.

In a further embodiment, the first affixing apparatus 128 may comprise a zipper, such as shown in FIG. 1 and FIG. 2. Aa first portion of a zipper may be formed on the curved edge of the first air-impermeable flap 126 and a second, mating portion of the zipper may be formed around the upper curved edge of the first air-permeable portion 124.

In another further embodiment, as shown in FIG. 3, the first affixing apparatus 128 may comprise a plurality of snap closures, e.g., grooved elements 328*a*, 328*b*, 328*c*, and 328*d*. In some embodiments, the grooved elements 328*a*, 328*b*, 328*c*, and 328*d* may be disposed on the upper edge of the flap 126 and each may be configured to mate with one of a plurality of studded elements 328*z*, 328*y*, 328*x*, and 328*w* disposed on the first air-impermeable portion 124 above and adjacent to the first air-permeable portion 124.

The first mattress cover 100 also comprises a second side layer (not visible in the perspective view of FIG. 1) comprising a second air-permeable portion, a second air-impermeable flap, and second affixing apparatus, wherein the second affixing apparatus is configured to reversibly affix the second air-impermeable flap over the second air-permeable portion. The second air-impermeable portion, the second air-permeable portion, the second air-impermeable flap, and the second affixing apparatus may be as described above regarding the first air-impermeable portion, the first air-permeable portion, the first air-impermeable flap, and the first affixing apparatus of the first side 120 layer.

The first mattress cover 100 depicted in FIG. 1 also comprises a head layer 140. The head layer 140 may be formed of substantially the same material as the first air-impermeable portion 122 and/or the top layer 110.

The first mattress cover 100 also comprises a foot layer (not shown in the perspective view of FIG. 1) which may be as described above regarding the head layer 140.

FIG. 2 illustrates a stylized first side view of the first mattress cover 100 in a second configuration, in accordance with embodiments herein. Specifically, FIG. 2 shows the second, open configuration of the first air-impermeable flap 126 and the first air-permeable portion 124. Referring to both FIG. 1 and FIG. 2, the first air-permeable portion and the first air-impermeable flap each has a crescent shape.

FIG. 3 illustrates a stylized first side view of a second mattress cover in a second configuration, in accordance with embodiments herein. The embodiment depicted in FIG. 3 is similar to that shown in FIG. 2, except that the first air-permeable portion 124 and the first air-impermeable flap 126 each have a substantially rectangular shape.

For illustrative purposes, FIG. 2 shows an embodiment wherein the first air-permeable portion 124 and the first air-impermeable flap 126 each have a crescent shape and the first affixing apparatus 128 is a zipper. For illustrative purposes, FIG. 3 shows an embodiment wherein the first air-permeable portion 124 and the first air-impermeable flap 126 each have a substantially rectangular shape and the first affixing apparatus 328 having a plurality of snap closures. However, those skilled in the art having benefit of the present disclosure would appreciate that the air-impermeable flaps may be implemented in various shapes and remain within the spirit and scope of embodiments herein. That is, the shape of the first air-permeable portion 124 and the first air-impermeable flap 126, on the one hand, and the structure of the first affixing apparatus 128/328, on the other hand, may be selected independently.

Figure 4:
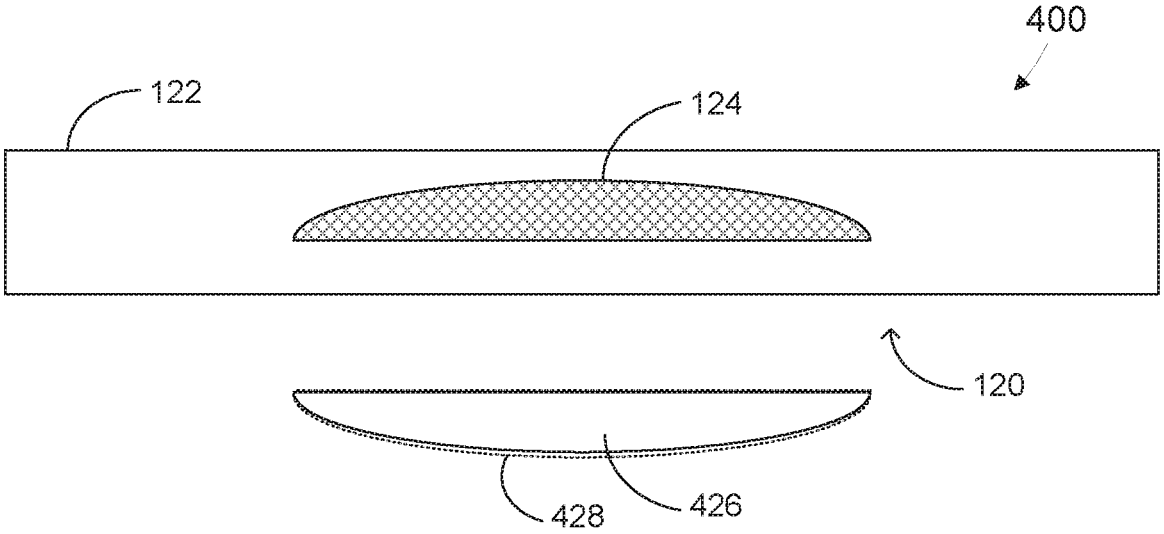
FIG. 4 illustrates a stylized first side view of a third mattress cover in a third configuration, in accordance with embodiments herein.

FIG. 4 illustrates a stylized first side view of a third mattress cover 400 in a third configuration, in accordance with embodiments herein. The embodiment depicted in FIG. 4 resembles the first mattress cover 100 of FIG. 1 and FIG. 2 in many particulars, but differs in that the first affixing apparatus 428 is a continuous zipper around the perimeter of the first air-impermeable flap 426. In other words, the first air-impermeable flap 426 is detachable from the first side layer 120 of the mattress cover 400.

As will be apparent to the person of ordinary skill in the art, other types of first affixing apparatus 428 may be configured to allow detachability of the first air-impermeable flap 426.

Figure 5:
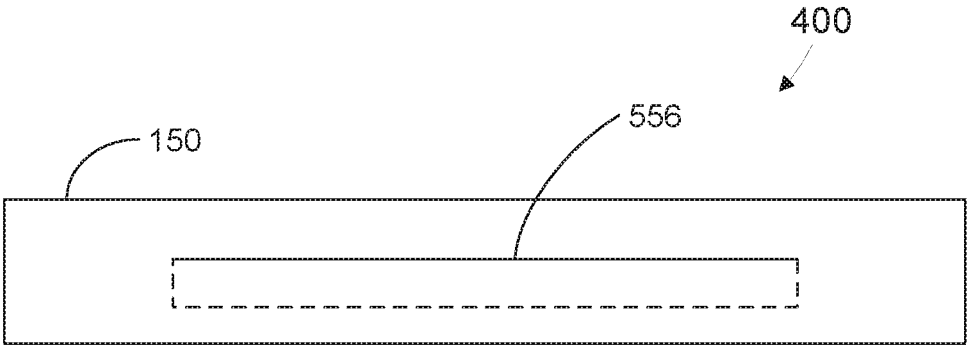
FIG. 5 illustrates a stylized foot view of a mattress cover, in accordance with embodiments herein.

FIG. 5 illustrates a stylized foot view of a mattress cover, in accordance with embodiments herein. The foot layer 150 can be made of substantially the same material as the head layer 140 described above. In the embodiment of FIG. 5, the foot layer 150 further comprises a pocket 556. The pocket 556 is wider than the detachable first air-impermeable flap 426 and is sized to contain both the first air-impermeable flap 426 and a second air-impermeable flap (not shown) from the second side layer (not shown), after the flaps have been detached and configured for storage (e.g., by rolling or folding). The pocket 556 allows convenient storage of detached flaps such as the detachable first air-impermeable flap 426 in proximity to the first and second air-permeable portions (e.g., first air-permeable portion 124) of the side layers (e.g., the first side layer 120).

Figure 6:
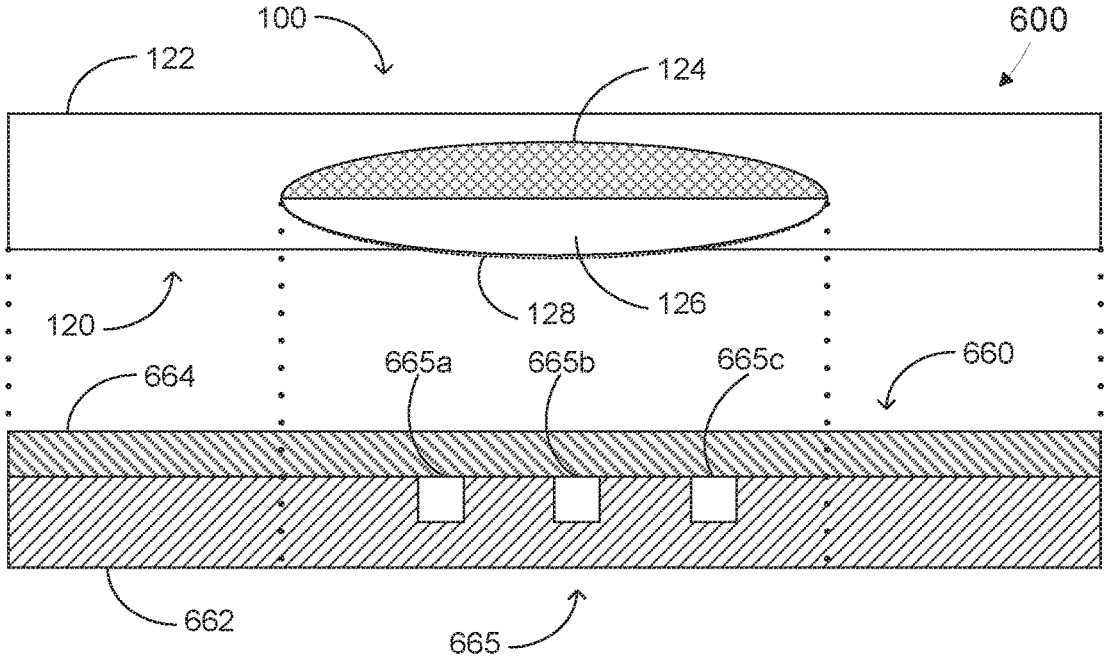
FIG. 6 illustrates a stylized first side view of a mattress assembly, in accordance with embodiments herein.

FIG. 6 illustrates a stylized first side view of a mattress assembly, in accordance with embodiments herein. The mattress assembly 600 comprises a mattress 660. Generally, the mattress 660 will have an opposed pair of long sides and an opposed pair of short sides. FIG. 6 shows one of the long sides of the mattress 660. However, a square mattress having all four sides of the same length may also be a component of the mattress assembly 600.

The mattress 660 also comprises at least one foam layer. In the particular embodiment shown in FIG. 6, the mattress 660 comprises at least one polyurethane layer (e.g., polyurethane layer 662) and at least one viscoelastic foam layer (e.g., viscoelastic foam layer 664) disposed over the at least one polyurethane layer.

The mattress 660 further comprises at least one continuous air passage 665 from one of the long sides to the other long side. The term "long side" is used herein to refer to a side parallel to the usual head-to-toe axis of a sleeping or reclining user. The person of ordinary skill in the art would readily adapt the present teachings to a square mattress or a mattress that is wider than long, e.g., where the shorter sides are parallel to the usual head-to-toe axis of a sleeping or reclining user. For example, the mattress 660 depicted in FIG. 6 comprises three continuous air passages 665*a*, 665*b*, and 665*c*.

FIG. 6 shows the continuous air passages 665*a*, 665*b*, and 665*c* as each having a square cross-section. However, any other cross-sectional shape, such as a rectangular shape, an oval shape, a circular shape, a wave shape, etc., may be used.

The mattress assembly 600 also comprises a mattress cover, such as mattress cover 100. Any mattress cover described above may be used in the mattress assembly 600. Regardless of the particular structure of the mattress cover, in the mattress assembly 600, the mattress cover (e.g., mattress cover 100) is positioned on the mattress such that the first air-permeable portion 124 and the second air-permeable portion (on the second side layer, not shown in the side view of FIG. 6) are each disposed over an opening of the at least one continuous air passage 665. For example, in the depicted embodiment, the first air-permeable portion 124 is disposed over the openings of the air passages 665*a*, 665*b*, and 665*c*. The disposition of the mattress cover over the mattress 600 accordingly permits the user to reversibly open and close the air-impermeable flaps (e.g., the first air-impermeable flap 126). This provides for permitting airflow through the at least one continuous air passage 665 when more cooling of the mattress 660 is desired by opening the flaps, and providing a pleasing appearance that resists the entry of undesired objects into the at least one continuous air passage 665 when the flaps are closed.

Figure 7:
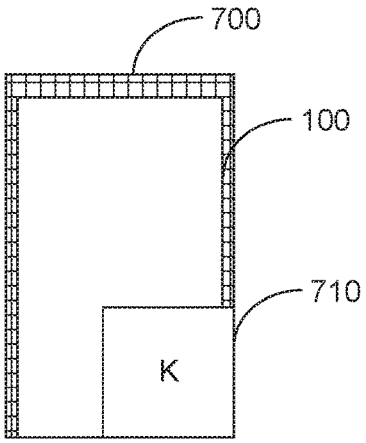
FIG. 7 illustrates a stylized front view of a first mattress cover package, in accordance with embodiments herein.
Figure 8:
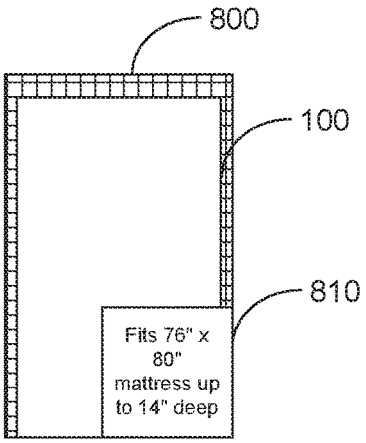
FIG. 8 illustrates a stylized front view of a second mattress cover package, in accordance with embodiments herein.
Figure 9:
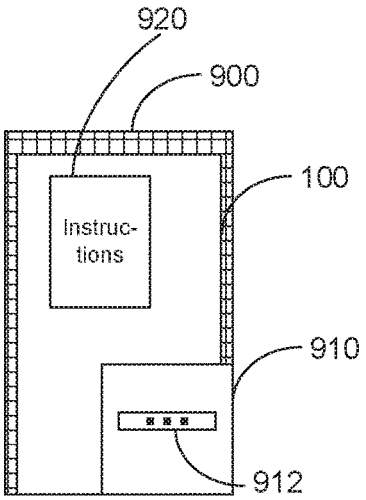
FIG. 9 illustrates a stylized front view of a third mattress cover package, in accordance with embodiments herein.

Turning to FIGS. 7-9, stylized front views of mattress cover packages are shown, in accordance with embodiments therein. FIG. 7 illustrates a stylized front view of a first mattress cover package 700. FIG. 8 illustrates a stylized front view of a second mattress cover package 800. FIG. 9 illustrates a stylized front view of a third mattress cover package 900.

In each of FIGS. 7-9, the mattress cover package, comprises a mattress cover as described above (e.g., mattress cover 100); and a label 710, 810, or 910 indicating one or more mattresses which the mattress cover is configured to fit.

In particular embodiments, the label 710, 810, or 910 indicates the one or more mattresses by at least one of a standard mattress size, a range of mattress dimensions, a mattress model name, or a graphical representation of at least one continuous air passage from a long side of the mattress to an opposite long side of the mattress. For example, in FIG. 7, the label 710 indicates the one or more mattresses by a standard mattress size (e.g., "K" for king). For another example, the label 810 shown in FIG. 8 indicates the one or more mattresses by a range of mattress dimensions. For yet another example, as shown in FIG. 9, the label 910 indicates the one or more mattresses by a graphical representation of at least one continuous air passage from a long side of the mattress to an opposite long side of the mattress.

As shown in FIG. 9, the mattress cover package 900 may also comprise a printed sheet of instructions 920 for fitting the mattress cover 100 to the one or more mattresses. As should be apparent, the printed sheet of instructions 920 could be included in one or more of mattress cover package 700, mattress cover package 800, etc.

The particular embodiments disclosed above are illustrative only, as the disclosure may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is, therefore, evident that the particular embodiments disclosed above may be altered or modified and all such variations are considered within the scope and spirit of the disclosure. Accordingly, the protection sought herein is as set forth in the claims below.

What is claimed is:

1. A mattress cover, comprising:

a top layer;

a first side layer comprising a first air-impermeable portion, a first air-permeable portion, a first air-impermeable flap, and first affixing apparatus, wherein the first affixing apparatus is configured to reversibly affix the first air-impermeable flap over the first air-permeable portion;

a second side layer comprising a second air-impermeable portion, a second air-permeable portion, a second air-impermeable flap, and second affixing apparatus, wherein the second affixing apparatus is configured to reversibly affix the second air-impermeable flap over the second air-permeable portion;

an air-impermeable head layer; and an air-impermeable foot layer;

wherein the first air-impermeable flap and the second air-impermeable flap are detachable; and at least one of the first side layer, the second side layer, the head layer, or the foot layer comprises at least one pocket configured to receive at least one of the first air-impermeable flap when detached and the second air-impermeable flap when detached.

2. The mattress cover of claim 1, wherein the first air-permeable portion and the second air-permeable portion each have a crescent shape.

3. The mattress cover of claim 1, wherein the first air-permeable portion and the second air-permeable portion each have a substantially rectangular shape.

4. The mattress cover of claim 1, wherein the first affixing apparatus and the second affixing apparatus are each selected from a zipper, one or more button closures, one or more snap closures, or one or more hook-and-loop closures.

5. A mattress assembly, comprising:

a mattress, having an opposed pair of long sides and an opposed pair of short sides, and comprising:

at least one foam layer; and at least one continuous air passage from one of the long sides to the other long side; and a mattress cover, comprising:

a top layer;

a first side layer comprising a first air-impermeable portion, a first air-permeable portion, a first air-impermeable flap, and first affixing apparatus, wherein the first affixing apparatus is configured to reversibly affix the first air-impermeable flap over the first air-permeable portion;

a second side layer comprising a second air-impermeable portion, a second air-permeable portion, a second air-impermeable flap, and second affixing apparatus, wherein the second affixing apparatus is configured to reversibly affix the second air-impermeable flap over the second air-permeable portion;

an air-impermeable head layer; and an air-impermeable foot layer;

wherein the mattress cover is positioned on the mattress such that the first air-permeable portion and the second air-permeable portion are each disposed over an opening of the at least one continuous air passage; the first air-impermeable flap and the second air-impermeable flap are detachable; and at least one of the first side layer, the second side layer, the head layer, or the foot layer comprises at least one pocket configured to receive at least one of the first air-impermeable flap when detached and the second air-impermeable flap when detached.

6. The mattress assembly of claim 5, wherein the first air-permeable portion and the second air-permeable portion each have a crescent shape.

7. The mattress assembly of claim 5, wherein the at least one continuous air passage has a rectangular cross-section.

8. The mattress assembly of claim 5, wherein the first affixing apparatus and the second affixing apparatus are each selected from a zipper, one or more button closures, one or more snap closures, or one or more hook-and-loop closures.

9. The mattress assembly of claim 5, wherein the mattress comprises at least one polyurethane layer and at least one viscoelastic foam layer disposed over the at least one polyurethane layer.

10. A mattress cover package, comprising:

a mattress cover, comprising:

a top layer;

a first side layer comprising a first air-impermeable portion, a first air-permeable portion, a first air-impermeable flap, and first affixing apparatus, wherein the first affixing apparatus is configured to reversibly affix the first air-impermeable flap over the first air-permeable portion;

a second side layer comprising a second air-impermeable portion, a second air-permeable portion, a second air-impermeable flap, and second affixing apparatus, wherein the second affixing apparatus is configured to reversibly affix the second air-impermeable flap over the second air-permeable portion;

an air-impermeable head layer; and an air-impermeable foot layer;

wherein the first air-impermeable flap and the second air-impermeable flap are detachable; and at least one of the first side layer, the second side layer, the head layer, or the foot layer comprises at least one pocket configured to receive at least one of the first air-impermeable flap when detached and the second air-impermeable flap when detached; and a label indicating one or more mattresses which the mattress cover is configured to fit.

11. The mattress cover package of claim 10, wherein the first air-permeable portion and the second air-permeable portion each have a crescent shape.

12. The mattress cover package of claim 10, wherein the first air-permeable portion and the second air-permeable portion each have a substantially rectangular shape.

13. The mattress cover package of claim 10, wherein the first affixing apparatus and the second affixing apparatus are each selected from a zipper, one or more button closures, one or more snap closures, or one or more hook-and-loop closures.

14. The mattress cover package of claim 10, wherein the label indicates the one or more mattresses by at least one of a standard mattress size, a range of mattress dimensions, a mattress model name, or a graphical representation of at least one continuous air passage from a long side of the mattress to an opposite long side of the mattress.

15. The mattress cover package of claim 10, further comprising:

instructions for fitting the mattress cover to the one or more mattresses.

* * * * *